United States Patent [19]

Cheng

[11] Patent Number: 5,020,996

[45] Date of Patent: Jun. 4, 1991

[54] DECORATIVE STRING CONTROL BOX

[76] Inventor: Pi-Yen Cheng, No. 2, Lane 188, Tung Kuang Rd., Hsinchu, Taiwan

[21] Appl. No.: 589,569

[22] Filed: Sep. 28, 1990

[51] Int. Cl.[5] ..... H01R 9/09

[52] U.S. Cl. ..... 439/76; 439/78

[58] Field of Search ..... 439/76, 78, 247, 248

[56] References Cited

U.S. PATENT DOCUMENTS

| | | | |
|---|---|---|---|
| 4,603,930 | 8/1986 | Ito | 439/76 |
| 4,685,753 | 8/1987 | Isshiki et al. | 439/76 |
| 4,850,884 | 7/1989 | Sawai et al. | 439/76 |
| 4,940,419 | 7/1990 | Kurita et al. | 439/76 |
| 4,952,529 | 8/1990 | Grider | 439/78 |
| 4,959,018 | 9/1990 | Yamamoto et al. | 439/76 |
| 4,963,099 | 10/1990 | Sato et al. | 439/76 |

*Primary Examiner*—Paula A. Bradley
*Attorney, Agent, or Firm*—Varndell Legal Group

[57] ABSTRACT

A decorative string control box, comprising a casing covered with a cover and a cap with a decorative string control circuit board fastened therein for fastening a plurality of decorative string conductor terminals. Each decorative string conductor terminal can be conveniently inserted through the wider left half part of each mounting slot at one end of the cover and pulled outward to engage in a recessed portion on the back side of the narrower right half part of each mounting slot and then firmly pressed by the cap in a position to electrically contact a corresponding contact on the decorative string control circuit board.

1 Claim, 2 Drawing Sheets

DECORATIVE STRING CONTROL BOX

BACKGROUND AND SUMMARY OF THE INVENTION

This invention relates generally to control boxes and relates more particularly to a control box for controlling the operation of a decorative string or Christmas tree light assembly.

A decorative string or Christmas tree light assembly is generally controlled through a control box to provide a variable lighting effect. The conventional decorative string control box is generally difficult to assemble. It is still inconvenient to fasten decorative string conductor terminals in a decorative string control box. The present invention is accomplished to eliminate these problems. It is the main object of the present invention to provides a decorative string control box which is inexpensive to manufacture, easy to assemble and convenient for fastening decorative string conductor terminals.

DETAILED DESCRIPTION OF THE PREFERRED EMBODIMENT

Figure 1:
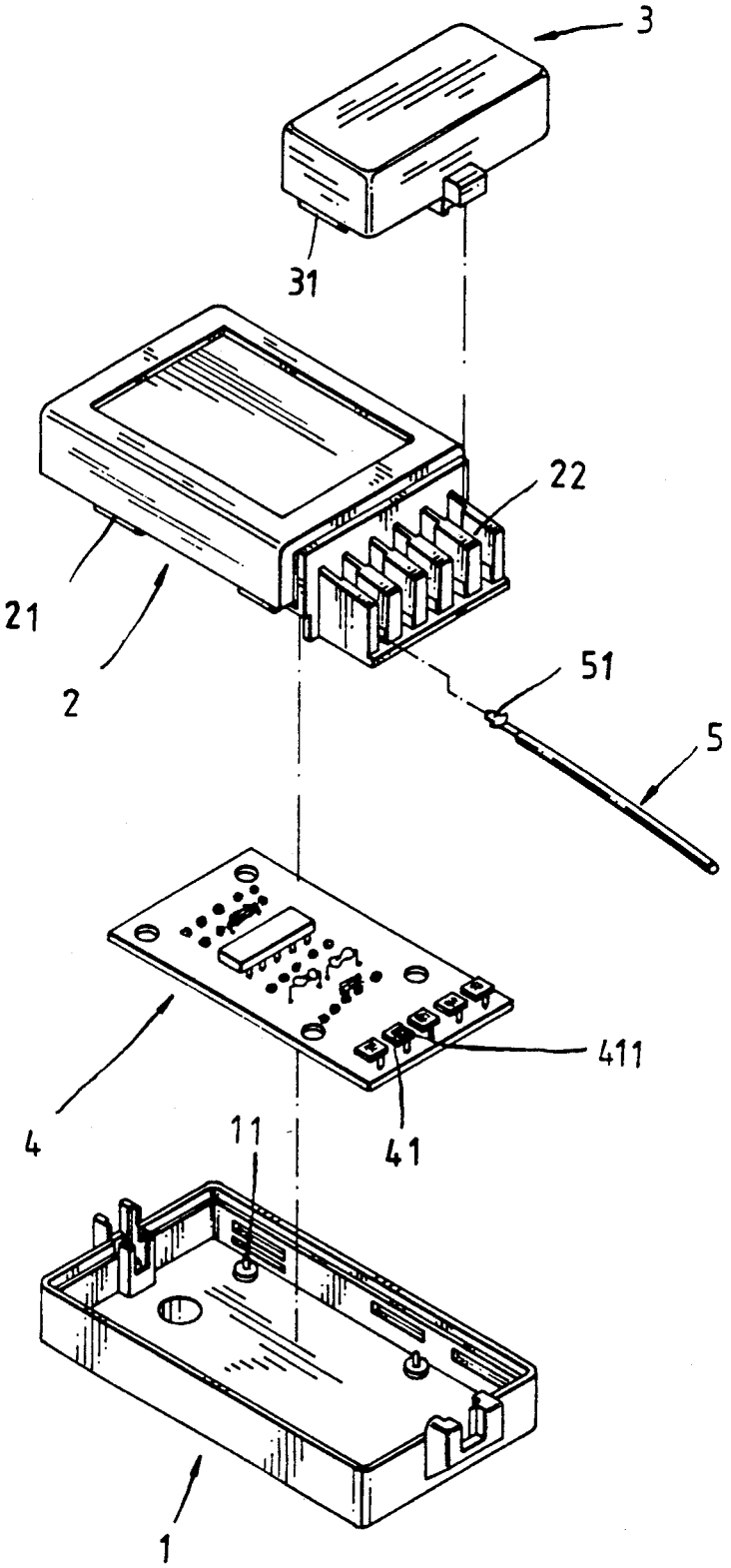
FIG. 1 is a perspective dismantled view of the preferred embodiment of the present invention.
Figure 3:
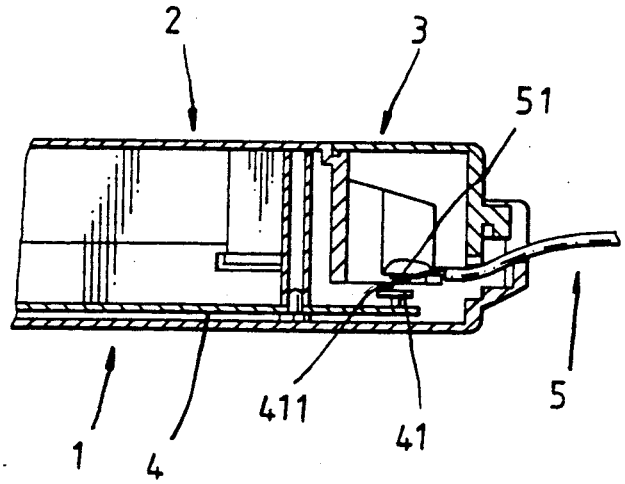
FIG. 3 is a sectional assembly view of the preferred embodiment of the present invention.

Turning now to the annexed drawings in greater detail and referring first to FIG. 1, therein illustrated is a decorative string control box embodying the present invention and generally comprised of a casing 1, a cover 2, a cap 3, and a control circuit board 4. The control circuit board 4 is fastened inside the casing 1 and covered by the cover 2 and the cap 3, that is that cover 2 and the cap 3 are longitudinally aligned to cover on the casing 1. The casing 1 has a plurality of female retainer portions 11 internally disposed at two opposite sides corresponding to a plurality of male retainer portions 21, 31 made on the cover 2 as well as the cap 3 at the bottom so that the cover 2 and the cap 3 and be conveniently secured to the casing 1. The control circuit board 4 is mounted with a variety of electronic component parts connected to a row of M-shaped copper strips 41 through soldering process. The row of M-shaped copper strips 41 are disposed on the control circuit board 4 at one end corresponding to the position of the cap 3. The quantity of the copper strips 41 on the control circuit board 4 is determined according to the quantity of the decorative string conductor terminals to connect.

Figure 2:
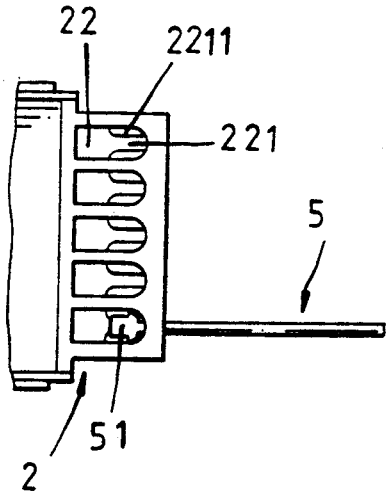
FIG. 2 is a partly back view of the preferred embodiment of the present invention, illustrating the connection of a conductor terminal in the upper cover.

Referring to FIG. 2, the terminals 51 of a regular decorative string conductor 5 is generally substantially shaped like " ". The cover 2 has a plurality of longitudinal mounting slots 22 vertically piercing therethrough at one end for fastening a decorative string conductor terminal 51 each. Each longitudinal slot 22 is designed in such a manner that its left half part is relatively wider and its right half part is relatively narrower. There is a recess portion 2211 made on the back side of the narrower right half part 221 of each mounting slot 22. Therefore, a decorative string conductor terminal 51 can be conveniently inserted through the wider left half part of a longitudinal slot 22 and then pulled outward to engage in the recessed portion 2211 of the narrower right half part 221 of the longitudinal slot 22 to become in contact with the conductive plate spring 411 of the corresponding copper strip 41. Once the cap 3 is mounted on the casing 1, the conductor terminal 51 becomes firmly retained in the corresponding mounting slot 22 and connected to the corresponding copper strip 41. During manufacturing process, the casing 1, the cover as well as the cap 3 can be respectively made through injection molding process to recude manufacturing cost. The row of M-shaped copper strips 41 can be soldered to a control circuit board 4 before a control circuit board 4 is mounted in a casing 1. Since no any additional fastening means is required to secure a cover 2 and a cap 3 to a casing 1 or to fasten decorative string conductor terminals 51 in the mounting slots 22 of a cover for electrically connection to the M-shaped copper strips 41 on a control circuit board 4, the present invention can be conveniently assembled.

I claim:

1. A decorative string control box, comprising a casing covered with a cover and a cap for holding a decorative string control circuit board permitting a plurality of decorative string conductor terminals to fasten in a plurality of mounting slots on said cover and secured by said cap to respectively electrically connect with a plurality of contacts on said control circuit board, characterized in that said mounting slots are each formed of a wider left half part and a narrower right half part with a recessed portion made on the back of said narrower right half part so that a decorative string conductor terminal can be conveniently inserted through said wider left half part and pulled outward to engage in said recessed portion and then firmly pressed by said cap in a position to electrically contact a corresponding contact on said decorative string control circuit board.

* * * * *